United States Patent [19]

Theurer

[11] 4,050,196

[45] Sept. 27, 1977

[54] RAIL GRINDING MACHINE

[75] Inventor: Josef Theurer, Vienna, Austria

[73] Assignee: Franz Plasser Bahnbaumaschinen-Industrie-gesellschaft m.b.H., Vienna, Austria

[21] Appl. No.: 735,016

[22] Filed: Oct. 22, 1976

[30] Foreign Application Priority Data

Dec. 1, 1975 · Austria ..... 9132/75

[51] Int. Cl.[2] ..... B24B 23/00

[52] U.S. Cl. ..... 51/178; 51/5 D

[58] Field of Search ..... 51/178, 5 D

[56] References Cited

U.S. PATENT DOCUMENTS

| | | | |
|---|---|---|---|
| 3,133,343 | 5/1964 | Kratkay | 51/178 |
| 3,526,997 | 9/1970 | Panetti | 51/178 |
| 3,738,066 | 6/1973 | Panetti | 51/178 |
| 3,945,152 | 3/1976 | Heinrich | 51/178 |

FOREIGN PATENT DOCUMENTS

| | | | |
|---|---|---|---|
| 2,255,435 | 5/1974 | Germany | 51/178 |

*Primary Examiner*—Harold D. Whitehead
*Assistant Examiner*—Roscoe V. Parker
*Attorney, Agent, or Firm*—Kurt Kelman

[57] ABSTRACT

A mobile rail grinding machine for grinding the running surface and inside of the railhead of the track rails comprises a forward, an intermediate and a rear grinding module spacedly arranged in an operating direction. The forward and rear modules each includes a carrier associated with each running surface half of each rail, a power drive for vertically moving the carriers, and two grinding wheels spaced on each carrier in the operating direction, each of the wheels having a circumferential grinding surface for grinding the associated running surface half. Flanged wheels guide each grinding module along the track rails. The intermediate grinding module has a carrier associated with each track rail, a power drive for moving the carriers parallel with respect to the track, and at least one grinding wheel on each carrier associated with the inside of the railhead of the associated rail for grinding the associated inside. Shaping tools are mounted on the carriers for profiling the grinding surfaces of the grinding wheels. At least the forward and rear modules are centered with respect to the track rails and their flanged wheels are pressed without play against the track rails they engage.

16 Claims, 4 Drawing Figures

RAIL GRINDING MACHINE

Figures 1, 2, 3:
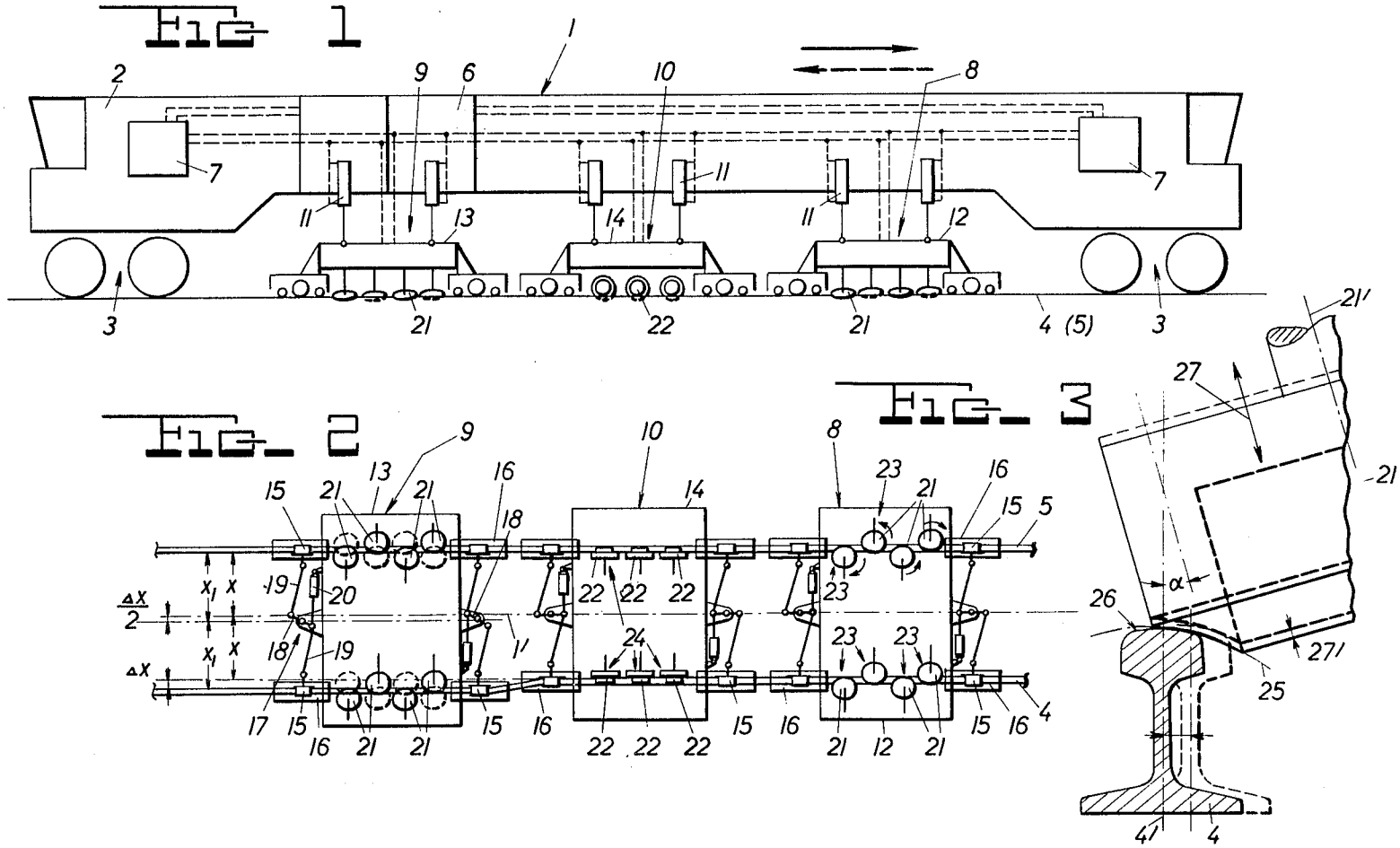

Copending application Ser. No. 708,017, filed July 23, 1976 and entitled "Rail Grinding Machine," discloses subject matter claimed herein.

The present invention relates to improvements in a mobile rail grinding machine for grinding away irregularities in the convex running surface and inside of the railheads of the rails of a track, i.e., the railhead faces which are in contact with the wheels of passing trains. Each track rail has a vertical plane of symmetry and respective halves of the running surface on each side of the plane of symmetry.

Modern-day high train speeds require the maintenance of a smooth running surface or tread of track rails for reasons of safety, economy and riding comfort. Because the rails are subjected to high loads and corresponding friction heats the rails at least on occasion up to the softening point of the steel rails, the rails wear relatively rapidly and lose their intended profile, the running surface and the inside of the railheads developing faults, such as burrs, ripples and the like. This unevenness of the rail tread subjects the train wheels to vibrations and shocks, which not only causes discomfort to the passengers but also unfavorably influences the track alignment and greatly increases the noise level. This, in turn, makes more frequent track maintanance work necessary. Therefore, the rails must be ground from time to time to eliminate the faults and smooth the running surfaces of the track rails. This has been done with grinding wheels which may be mounted on light rail grinding machines or rail grinding trains.

German published patent application (Offenlegungsschrift) No. 2,255,435 discloses a rail grinding machine with a series of grinding wheels for grinding the running surface of the rails of a track, which comprises a track or road going vehicle and a machine frame which is vertically movably supported on the vehicle. In its lowered position, the machine frame is guided without play on the track rails by means of sliding blocks and track rail engaging elements. The machine frame carries a vertically movable carrier with a grinding tool associated with each rail for grinding the entire running surface of the rail heads. Furthermore, a shaping tool for profiling the grinding surface of the grinding tool in conformity with the desired profile of the running surface is associated with each grinding tool, the shaping tool being vertically movable relative to the tool carrier. This arrangement does not make it possible to grind the running surfaces of the track rails accurately to their desired profiles since only a single grinding disc is provided per rail and the grinding discs are at a fixed distance transversely to the track. Thus, even minimal variations in the track gauge or inaccurate adjustments of the grinding tools in connection with the associated shaping tools will cause undesired excess grinding. Furthermore, very time-consuming adjustments are necessary and accurate grinding of both track rails simultaneously is not possible with this machine.

German published patent application (Offenlegungsschrift) No. 2,410,564 discloses a rail grinding machine wherein a grinding unit with a grinding wheel is mounted on a vertically movable carrier whose vertical position is determined by a rail sensing element. The guide elements for the carrier are mounted on a carrier frame which is pivotal about an axle mounted on the machine frame and extending parallel to the track. Grinding is effected by operating the grinding tool sequentially and in successive stages over the entire profile of the rail head. This is, of course, exceedingly time-consuming, particularly since it requires adjustments in connection with the rail sensing element at each operating stage and, in addition, fails to produce an accurate rail head profile since a series of adjacent grinding strips are produced which do not give a smooth surface. Furthermore, this machine, too, makes no allowance for variations in the track gauge without making time-consuming adjustments to achieve accurate grinding. It is not possible to obtain accurate grinding of both track rails simultaneously with this known machine.

It is the primary object of this invention to provide a mobile rail grinding machine which not only makes it possible to grind the running surface and inside the ground the railhead of track rails very accurately but which works on both rails simultaneously and avoids asymmetricaly faults in the ground rails with respect to each other.

This and other objects are accomplished in accordance with the invention with a machine comprising a forward and a rear grinding module spacedly arranged in an operating direction, and an intermediate grinding module arranged between the forward and rear grinding modules. Each of the forward and rear modules includes a carrier associated with each running surface half of each of the track rails, power-driven means for vertically moving the carriers, two rotatable grinding wheels on each carrier associated with respective ones of the running surface halves, the grinding wheels being spaced in the operating direction and each of the wheels having a circumferential grinding surface arranged for grinding the associated running surface half of the railhead of the associated track rail, and track rail engaging elements guiding each grinding module along the track rails. The intermediate grinding module includes a carrier associated with each of the track rails, at least one grinding wheel on each carrier associated with the inside of the railhead of the associated track rail for grinding the associated inside, and power-driven means for moving the carriers parallel with respect to the track. Shaping tools are mounted on the carriers for profiling the grinding surfaces of the grinding wheels, and means are provided for centering at least the forward and rear grinding modules with respect to the track rails and for pressing the track rail engaging elements without play against the track rails they engage.

In one embodiment, the grinding modules are comprised of two frame parts, the carriers associated with each of the track rails being mounted on a respective frame part and each frame part being guided on the track rails by track rail engaging elements, and the centering means comprises means for moving the frame parts laterally with respect to each other to press their rail engaging elements into engagement with the associated rail without play.

In another embodiment, the grinding modules are frame units on which the carriers are mounted, the track rail engaging elements guiding the frame units along the track rails, and the centering means comprising a lever system acting upon the track rail engaging elements.

A mobile rail grinding machine of this structure makes it possible to adjust all grinding wheels in relation to the railhead to be ground accurately to all requirements to obtain high-quality work and a symmetrical profile for both rails of the track. The work is always centered with respect to the track in a manner of the trains running thereon and taking into account all variations in the track gauge. Both track rails are ground in a single pass and differences in track gauge or track position, such as changes in the superelevation, do not disadvantageously affect the work. The arrangement of the grinding wheels on the forward grinding module, the intermediate module and the rear module enable the running surface and inside of the railheads to be fully ground in a single pass, the running surface first receiving a preliminary grind, the inside being ground subsequently, and the running surface finally receiving its finishing grind. While obtaining these advantages, the structure of the machine is relatively simple and the machine may be operated in both directions along the track, thus increasing the economy of the apparatus.

Figure 4:
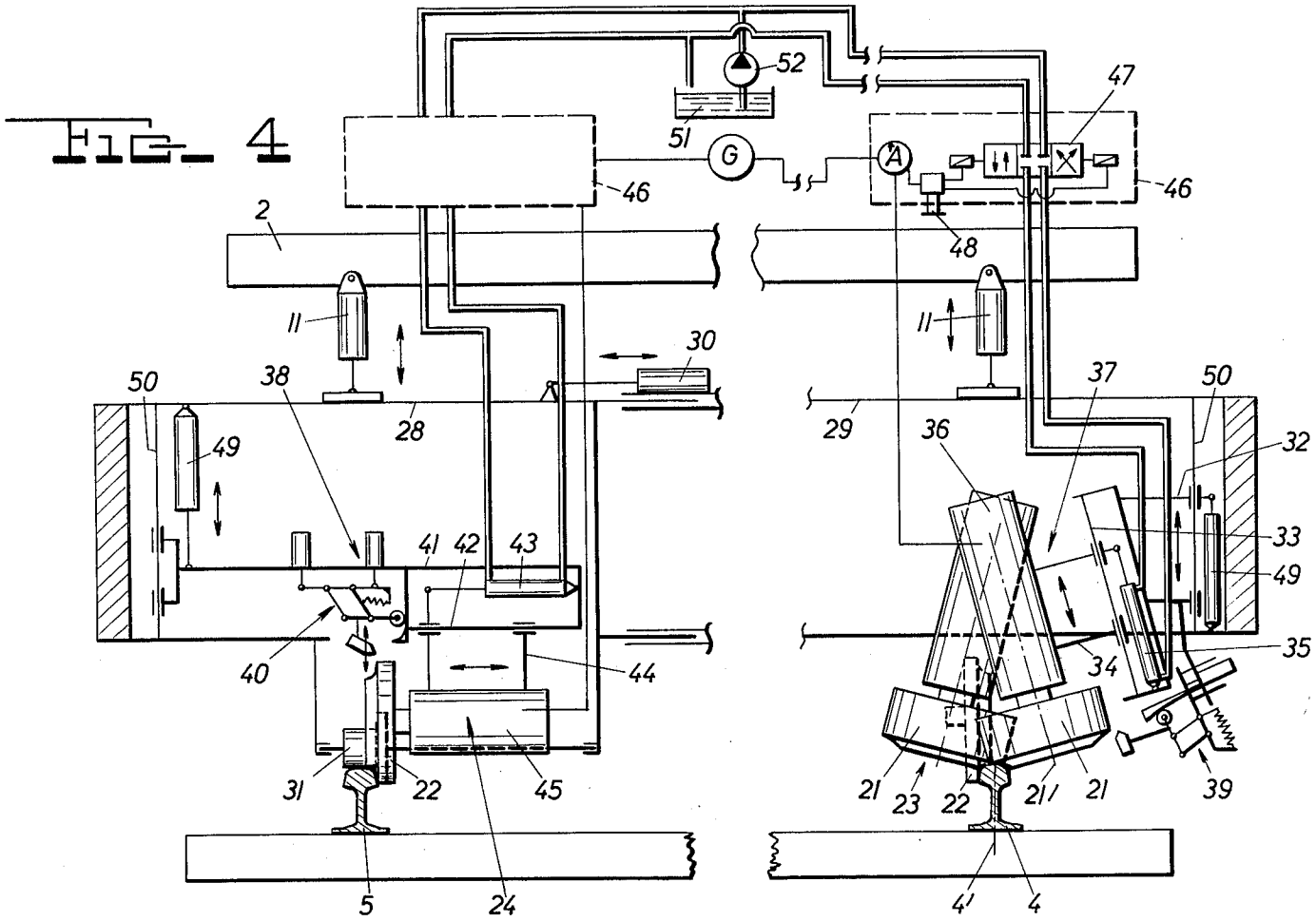

The above and otherobjects, advantages and features of the present invention will become more apparent from the following detailed description of certain now preferred embodiments, taken in conjunction with the accompanying schematic drawing wherein FIG. 1 is a side elevational view of a mobile rail grinding machine according to one embodiment of the invention;

FIG. 2 is a top view showing merely the grinding modules of the machine of FIG. 1;

FIG. 3 is an enlarged partial end view of a rotatable grinding wheel, with its circumferential grinding surface in grinding contact with the associated running surface half of a rail shown in section; and FIG. 4 is a schematic end view, partly in section, of an embodiment of a grinding module differing from the embodiment shown in FIGS. 1 and 2 primarily by providing separate frame parts rather than a frame unit.

Referring now to the drawing and first to FIG. 1, there is shown a mobile rail grinding machine 1 with a machine frame 2 mounted on undercarriages 3 for mobility on track rails 4 and 5. A hydraulic fluid supply tank and other required drive means for the machine are mounted on machine frame 2 at 6 and, as indicated by the broken lines, the drive means are controlled from operator's cabins 7, 7 in a suitable and conventional manner. As shown by the horizontal arrows, machine 1 may be operated in either direction along track 4, 5. Grinding modules 8, 9 and 10 are mounted on machine frame 2 which forms a bridge supported on undercarriages 3, 3. Hydraulic drives 11 vertically adjustably mount the grinding modules on the machine frame. In this manner, the grinding modules may be lifted off the track and the machine may travel at high speed from one working site to the next. Grinding modules 8 and 9 are the forward and rear modules which serve to grind the running surfaces of the railheads of the track rails, the grinding wheels on these modules pre-grinding and finishing the running surfaces respectively, depending on the operating direction of the machine. Intermediate grinding module 10 serves to grind the insides of the rails. In the embodiment of FIGS. 1 and 2, each grinding module is a frame unit 12, 13, 14 and the frame units are supported on undercarriages 16 which carry track rail engaging elements consisting of flanged wheels 15 mounted for movement transversely of the track rails for guiding each grinding module along the track rails.

As shown in FIG. 2, means is provided for centering the grinding module frame units with respect to rails 4 and 5, and for pressing the track rail engaging elements 15 without play against the track rail they engage. In this embodiment, the centering means comprises a lever system acting upon flanged wheels 15. The illustrated lever system includes two-armed lever 18 mounted on each frame unit for pivoting about an axis perpendicular to the track and a push rod 19 linked respectively to one of the lever arms and a respective one of flanged wheels 15 in engagement with a respective one of rails 4, 5. Power drive 20, which has been illustrated as a hydraulic motor, is linked to lever 18 for pivoting the same and thereby to press the transversely movable flanged wheels laterally into clearance-free engagement with the track rails. Two-armed lever 18 is mounted substantially centrally between the track rails.

Such a centering system assures the universal adaptation of the grinding wheels to various track gauges and positions so as to improve the symmetry of the work on both rails. The centered power drive for the lever system produces a fully balanced centering of the modules and their grinding wheels. As shown in connection with module 9 (frame unit 13), when the track gauge deviates by $\Delta x$ from normal gauge $2x$, power drive 20 will press push rods 19 laterally apart and since two-armed lever 18 is centered on frame unit 13 with respect to the track rails, each push rod is moved by half the gauge deviation, i.e., $\Delta x/2$, transversely to the track. Center axis 1' of frame unit 13 is then equidistant from rails 4, 5, being spaced therefrom by distance $x_1$ while this center axis is centered between the rails at normal gauge, being spaced therefrom by distance $x$, i.e., half the normal gauge.

As is seen in FIG. 4, forward and rear grinding modules 8 and 9 each include carriers 37 associated with each running surface half of each track rail while intermediate grinding module 10 includes carrier 38 associated with each track rail. Each carrier includes supports 34 and 44, respectively, for rotatable grinding wheels 21 and 22, respectively. As best shown in FIG. 2, two rotatable grinding wheels 21 on each carrier 37 are associated with respective halves of convex running surface 26 of each railhead. Grinding wheels 21 are spaced in the operating direction and each wheel has a circumferential grinding surface arranged for grinding the associated running surface half of the railhead associated track rail, as best seen in FIG. 3. Carriers 37 and 38 are power-driven for vertical movement by hydraulic motors 49 for vertical reciprocation in relation to the grinding module frame on which the carriers are mounted.

Grinding wheels 22 on carriers 38 are associated with the inside of the railhead of the associated track rail for grinding the associated inside, the supports 44 of grinding wheels 22 being power-driven by hydraulic motor 43 for moving the grinding wheels parallel with respect to the track. Pairs of grinding wheels 21 form grinding tool units 23 while grinding wheels 22 on each carrier constitute grinding tool units 24.

As is shown in FIG. 4, supports 34 for grinding wheels 21 are mounted on guide means constituted by columns 33 for vertically and transversely moving the supports on carriers 37 in a plane extending transverse to the operating direction and perpendicularly to a plane defined by the track rails. Supports 44 for grinding wheels 22 are mounted on guide columns 42 for moving the supports laterally in this transverse plane. Guide columns 33 extend obliquely to the plane defined by the track rails in the transverse plane for simultaneously moving supports 34 vertically in the transverse plane while moving them transversely. Each grinding wheel 21 has an axis of rotation 21' extending obliquely to the plane defined by the track rails and in the transverse plane, the axes of rotation of the grinding wheels forming a tool unit 23 and associated with respective ones of the running surface halves enclosing an acute angle $2\alpha$ in the transverse plane and intersecting in the plane of symmetry 4' above the associated track rail. The axes of rotation are symmetrically disposed with respect to the plane of symmetry.

The operation of tool units 23 is well illustrated in FIG. 3. Each grinding wheel 21 has a concave annular grinding surface, and common enveloping curve 25 defined by the annular grinding surfaces of a pair of grinding wheels forming unit 23 conforms to convex curvature 26 of the running surface. The arcuate enveloping curve is shaped so that at least one half of the running surface is ground by each grinding heel 21 even if the distance between grinding wheel axis of rotation 21' and rail plane of symmetry 4' is changed, as can be seen in the broken-line showing of FIG. 3. If there is such a change in distance due to a change in the track gauge, grinding wheel 21 need merely be moved in the direction of arrow 27 along guide column 33 to adjust the vertical and transverse position of the grinding wheel accordingly. While the drawing illustrates a lifting of the grinding wheel, the grinding wheel will be lowered if the track gauge widens, i.e., the rail moves in the opposite direction. The convex running surface halves are symmetrical in relation to plane of symmetry 4' and to make it possible to have grinding contact with at least one half of the running surface by each grinding wheel in all positions of the wheel, axis of rotation 21' is inclined with respect to the plane by an angle $\alpha$. In the illustrated embodiment, this angle is 15°. The center of the circular arc described by the concave grinding surfaces of the cooperating grinding wheels of each unit 23 is in plane of symmetry 4' and is independent of the magnitude of angle $\alpha$.

As will be appreciated from a combined consideration of FIGS. 3 and 4, a correct grinding position with a common enveloping curve 25 over the running surface of the railhead will be obtained simply by adjusting the grinding wheel by distance 27' in the direction of arrow 27 in the embodiment of the grinding module shown in FIGS. 1 and 2, wherein the grinding wheels are mounted on a frame unit for each module, which is centered by lever system 18, 19. However, if the grinding module is comprised of two separate frame parts 28, 29, the carriers associated with each track rail being mounted on a respective one of the frame parts and each frame part being guided on the track rails by flanged wheels 31 fixedly mounted on the frame parts, such as grinding module may be centered by means illustrated as hydraulic motor 30 for moving frame parts 28, 29 laterally with respect to each other to press their flanged wheels into engagement with the associated track rail. This will properly position the grinding wheels with respect to their associated rails without requiring further adjustment.

As will be seen in FIG. 4, supports 34 for grinding wheels 21 are staggered on carriers 37 associated with each running surface half in the operating direction, and the supports are mirror-symmetrically arranged with respect to the associated rail. This arrangement makes ready adjustment to different track gauges very simple and two tool units 23 suffice for effectively grinding and finishing the entire running surface. The profiling of the circumferential grinding surfaces of the cooperating grinding wheels of each unit to form a common enveloping curve produces an accurate and symmetrical ground running surface with every adjustment due to differing track gauges. Mounting of supports 44 of grinding wheels 22 for movement along guide columns 42 parallel to the track make it possible to keep the annular grinding surfaces of grinding wheels 22 always in grinding contact with the inside of the railheads as the track gauge changes, no lifting of the grinding wheels being required for grinding the railhead insides, regardless of the track gauge.

As shown in FIG. 4, carrier frame 32 supports oblique guide column 33 for the grinding wheel support 34 and is vertically movable on frame part 29 along support columns 50 by hydraulic motor 49, carrier frame 41 being similarly supported on columns 50 for vertical movement on frame part 28. Grinding wheels 21 are rotated by electric motors 36 while grinding wheels 22 are rotated by electric motors 45. As shown by small arrows in FIG. 2, adjacent grinding wheels 21 are rotated in opposite directions.

FIG. 4 permits of two different readings. It would be possible to mount both types of grinding wheels 21 and 22 for respectively grinding the running surfaces and insides of the track rails sequentially on the same grinding module, i.e., to arrange grinding wheels 22 between two tool units 23, as indicated in broken lines at the right side of FIG. 4, where wheel 22 is shown behind the pair of wheels 21, the left side of FIG. 4 then showing an end view staggered in the operating direction from the end view shown on the right side. On the other hand, the left side of FIG. 4 may be understood to show an end view of one frame part of a grinding module 10 which has a like frame part associated with the other rail (not shown) while the right side shows an end view of one frame part of a grinding module 8 or 9 which has a like frame part associated with the other rail (not shown).

Wear on the annular grinding surfaces of the grinding wheels and proper shaping thereof is obtained by shaping tools 39 and 40, respectively, which are mounted on carriers 37 and 41 for profiling the grinding surfaces. The parallelogram mechanism for properly guiding the shaping tools is fully described and illustrated in my copending application Ser. No. 708,017, filed July 23, 1976, and whose entire disclosure is incorporated herein by way of reference.

As shown in FIG. 4, hydraulic motors 35 and 43, which properly position the grinding wheel supports with respect to the associated rails and thus assure accurate grinding, are each operated by control 46 which includes servo-valve 47 mounted in the hydraulic circuit connected between hydraulic fluid sump 51 and the respective hydraulic motor, pump 52 delivering the hydraulic fluid to the motors 35 and 43, as controlled by the servo-valve. The servo-valve is electrically operated by connection to a voltage source illustrated as generator G which is also connected to electric motors 36 and 45 for rotating the grinding wheels. The solenoids of the servo-valve are connected to the electric control circuit leading from generator G to the electric motors by threshold switch 48 which may be actuated manually and which responds to the electric current received by electric motors 36 and 45, the desired grinding depth being adjusted by selecting a threshold switch position corresponding to an electric current consumption corresponding to such a depth. This control also makes it possible automatically to reposition the grinding wheels when the track gauge changes since, when the track gauge narrows and the track rail thus moves closer to the associated grinding wheel, the current consumption of the electric motor will increase to overcome the added resistance to the rotation of the grinding wheel, thus causing motors 35 and 43 to move the grinding wheels correspondingly away from the associated rail until the grinding wheels have re-assumed their original relationship with the rail. The control operation is more fully described in the copending application mentioned hereinabove.

In the embodiment of FIGS. 1 and 2, all grinding modules consist of frame units which are centered by like lever systems 17, thus assuring symmetrical grinding of both rails. But it may be preferred, particularly for grinding modules 8 and 9, to build two-frame part modules, with frame parts 28 and 29 of each module being laterally adjustable in relation to each other for centering the above-indicated manner. Since the fixed flanged wheels 31 will guide the frame parts automatically parallel to the track plane, symmetrical working will be assured.

The mirror-symmetric arrangement of the grinding wheels of units 23 associated with each rail and a like arrangement with respect to each other of the units associated with both rails is shown in the top view of FIG. 2 and the ability of the grinding wheel supports to be moved symmetrically, particularly in conjunction with the centering of the grinding modules, produces a highly accurate and fully symmetrical grinding of the rails since, in the same transverse plane, the grinding wheels associated with the same running surface halves are operated simultaneously. The staggered arrangement of the grinding wheels 21 assures overlapping of the grinding zones and thus avoids overheating of the rails by grinding sequentially in the same surface zones of the railhead. The mirror-symmetrical movement of the grinding wheel supports assures a proper equilibrium of the driving forces.

What is claimed is:

1. A mobile rail grinding machine for grinding the running surface and inside of the railhead of track rails, each track rail having a vertical plane of symmetry and respective halves of the running surface on each side of the plane of symmetry, comprising 1. a forward and a rear grinding module spacedly arranged in an operating direction, each of the grinding modules including
   a. a carrier associated with each running surface half of each of the track rails,
   b. power-driven means for moving the carriers,
   c. two rotatable grinding wheels on each carrier associated with respective ones of the running surface halves, the grinding wheels being spaced in the operating direction and each of the wheels having a circumferential grinding surface arranged for grinding the associated running surface half of the railhead of the associated track rail, and
   d. track rail engaging elements guiding each grinding module along the track rails;
2. an intermediate grinding module arranged between the forward and rear grinding modules, the intermediate grinding module including
   a. a carrier associated with each of the track rails,
   b. at least one grinding wheel on each carrier associated with the inside of the railhead of the associated track rail for grinding the associated inside, and
   c. power-driven means for moving the grinding wheels of the intermediate grinding module parallel with respect to the track;
3. shaping tools on the carriers for profiling the grinding surfaces of the grinding wheels; and
4. means for centering the forward and rear grinding modules with respect to the track rails and for pressing the track rail engaging elements without play against the track rails they engage.

2. The mobile rail grinding machine of claim 1, wherein the forward and rear grinding modules are frame units on which the carriers are mounted, the track rail engaging elements guiding the frame units along the track rails, and the centering means comprising a lever system acting upon the track rail engaging elements.

3. The mobile rail grinding machine of claim 1, wherein each forward and rear grinding module is comprised of two frame parts, the carriers associated with each of the track rails being mounted on a respective one of the frame parts and each frame part being guided on the track rails by the track rail engaging elements, and the centering means comprises means for moving the frame parts laterally with respect to each other to press their rail engaging elements into engagement with the associated rail without play.

4. The mobile rail grinding machine of claim 1, further comprising a support for each of the grinding wheels, and guide means for vertically and transversely movably mounting the grinding wheel supports on the carriers in a plane extending transverse to the operating direction and perpendicularly to a plane defined by the track rails.

5. The mobile rail grinding machine of claim 4, wherein the guide means for the grinding wheel supports on the intermediate grinding module comprises guide columns for moving the supports laterally in the transverse plane parallel to the plane defined by the track rails, and means for vertically moving the grinding module carriers in the transverse plane.

6. The mobile rail grinding machine of claim 4, wherein the guide means for the grinding wheel supports on the forward and rear grinding modules comprises guide columns extending obliquely to the plane defined by the track rails in the transverse plane for simultaneously moving the supports transversely, each of the rotatable grinding wheels having an axis of rotation extending obliquely to the plane defined by the track rails and in the transverse plane, the axes of rotation of the grinding wheels associated with respective ones of the running surface halves enclosing an acute angle in the transverse plane and intersecting in the plane of symmetry above the associated track rail, the axes of rotation being symmetrically disposed with respect to the plane of symmetry.

7. The mobile rail grinding machine of claim 6, wherein each of the grinding wheels on the forward and rear grinding modules has a concave annular grinding surface, the running surface being convexly curved and a common enveloping curve defined by the annular grinding surfaces of the grinding wheels associated with respective ones of the running surface halves conforming to the convex curvature of the running surface, the grinding wheels being transversely adjustable in relation to each other with respect to the associated track rail whereby different shapes are imparted to the common enveloping curve.

8. The mobile rail grinding machine of claim 1, further comprising a support for each of the rotatable grinding wheels on the forward and rear grinding modules, the supports being movable symmetrically with respect to the plane of symmetry.

9. The mobile rail grinding machine of claim 1, further comprising a support for each of the grinding wheels on the forward and rear grinding modules, the supports being staggered on the respective carriers associated with each running surface half in the operating direction, and the supports on the carriers associated with one of the track rails being mirror-symmetrically arranged with respect to the supports on the carriers associated with the other track rail.

10. The mobile rail grinding machine of claim 1, further comprising a support for each of the grinding wheels on the forward and rear grinding modules, the supports on the carriers of the forward grinding module associated with one of the track rails being arranged mirror-symmetrically with respect to the supports on the carriers associated with the other track rail and with respect to the supports on the carriers of the rear grinding module associated with the same track rail.

11. The mobile rail grinding machine of claim 1, further comprising a support for each of the grinding wheels on the intermediate grinding module, the supports on the carrier associated with respective ones of the track rails being mirror-symmetrically arranged with respect to each other.

12. The mobile rail grinding machine of claim 1, further comprising a support for each of the grinding wheels on the forward and rear grinding modules, a pair of the supports being mounted on each of the carriers associated with a respective one of the running surface halves, the pairs of supports being staggered from each other in the operating direction, one of the grinding wheels of each pair being positioned between the two grinding wheels of the other pair.

13. The mobile rail grinding machine of claim 1, wherein the grinding modules are frame units on which the carriers are mounted, the track rail engaging elements are flanged wheels guiding the frame units along the track rails, and the centering means for each grinding module comprises a lever system including a two-armed lever mounted on each frame unit for pivoting about an axis perpendicular to the track, a push rod linked respectively to one of the lever arms and a respective one of the flanged wheels in engagement with a respective one of the track rails, the flanged wheels being mounted for movement transversely of the track rails, and a power drive linked to the lever for pivoting the same and pressing the flanged wheels laterally into engagement with the track rails.

14. The mobile rail grinding machine of claim 13, wherein the two-armed lever is mounted substantially centrally between the track rails.

15. The mobile rail grinding machine of claim 1, further comprising a machine frame mounted for mobility on the track rails, the grinding modules being vertically adjustably mounted on the machine frame.

16. The mobile rail grinding machine of claim 1, further comprising a support for each of the grinding wheels, a hydraulic motor for moving each support in relation to the associated track rail, an electric motor for rotating each of the grinding wheels, a source of electric current for the electric motor, and a control for operating the hydraulic motors of the supports associated with a respective one of the running surface sides of the associated track rail, the control including a servovalve supplying hydraulic fluid to the hydraulic motors in response to the electric current received by the electric motors of the grinding wheels.

* * * * *